US009375952B2

(12) United States Patent
Biglari et al.

(10) Patent No.: US 9,375,952 B2
(45) Date of Patent: Jun. 28, 2016

(54) SENSORLESS FUNCTION MONITORING OF DRYING VIA PLAUSIBILITY MONITORING OF POWER CONSUMPTION

(71) Applicant: Oce Printing Systems GmbH & Co. KG, Poing (DE)

(72) Inventors: Mehrad Biglari, Munich (DE); Robert Heimbach, Munich (DE); Robert Lang, Allershausen (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 14/823,373

(22) Filed: Aug. 11, 2015

(65) Prior Publication Data

US 2016/0046133 A1 Feb. 18, 2016

(30) Foreign Application Priority Data

Aug. 12, 2014 (DE) ..... 10 2014 111 465

(51) Int. Cl.

| | |
|---|---|
| ***B41J 29/38*** | (2006.01) |
| ***B41J 2/01*** | (2006.01) |
| ***B41J 11/00*** | (2006.01) |

(52) U.S. Cl.
CPC ..... *B41J 11/002* (2013.01)

(58) Field of Classification Search
CPC ..... B41J 11/002; B41J 11/0005
USPC ..... 347/16, 101, 102
See application file for complete search history.

(56) References Cited

U.S. PATENT DOCUMENTS

| | | | |
|---|---|---|---|
| 2009/0244147 | A1 | 10/2009 | Ohtsu et al. |
| 2012/0176439 | A1 | 7/2012 | Kanai et al. |
| 2013/0027489 | A1 | 1/2013 | Suzuki et al. |

FOREIGN PATENT DOCUMENTS

| | | | |
|---|---|---|---|
| DE | 4118645 | A1 | 1/1992 |
| EP | 2730419 | A1 | 5/2014 |

*Primary Examiner* — Jannelle M Lebron
(74) *Attorney, Agent, or Firm* — Schiff Hardin LLP

(57) ABSTRACT

In a method or device to determine a lift state of a recording medium from a surface of a heating saddle of an inkjet printing system, the recording medium being directed past the surface for drying, an index for power consumption of the heating saddle is determined including a determination of a time curve of the electrical power consumed by the heating saddle. The power consumption of the heating saddle depends on a desired temperature of the heating saddle. The lift state of the recording medium is determined based on the index for the power consumption.

11 Claims, 3 Drawing Sheets

SENSORLESS FUNCTION MONITORING OF DRYING VIA PLAUSIBILITY MONITORING OF POWER CONSUMPTION

BACKGROUND

The disclosure concerns a device and a corresponding method to monitor the drying in inkjet printing systems.

Inkjet printing systems may be used to print to recording media (such as paper, for example). For this, one or more nozzles may be used in order to spray, fire or throw ink droplets onto the recording medium, and in order to thus generate a desired print image on the recording medium.

An inkjet printing system may comprise one or more dryers in order to dry the recording medium after application of the print image, and in order to thus fix the applied ink onto the recording medium (as known from US2013/0235138A1). An insufficient drying of the recording medium may lead to the situation that the print image is smeared by the following processing steps and/or that components of the inkjet printing system are contaminated or soiled by insufficiently dried ink.

SUMMARY

It is an object to efficiently monitor the state of a dryer of an inkjet printing system or the state of a recording medium at the output of a dryer. In particular, it should thereby be efficiently determined whether a sufficient drying of the recording medium takes place.

In a method or device to determine a lift state of a recording medium from a surface of a heating saddle of an inkjet printing system, the recording medium being directed past the surface for drying, an index for power consumption of the heating saddle is determined including a determination of a time curve of the electrical power consumed by the heating saddle. The power consumption of the heating saddle depends on a desired temperature of the heating saddle. The lift state of the recording medium is determined based on the index for the power consumption.

DESCRIPTION OF EXEMPLARY EMBODIMENTS

Figure 1:
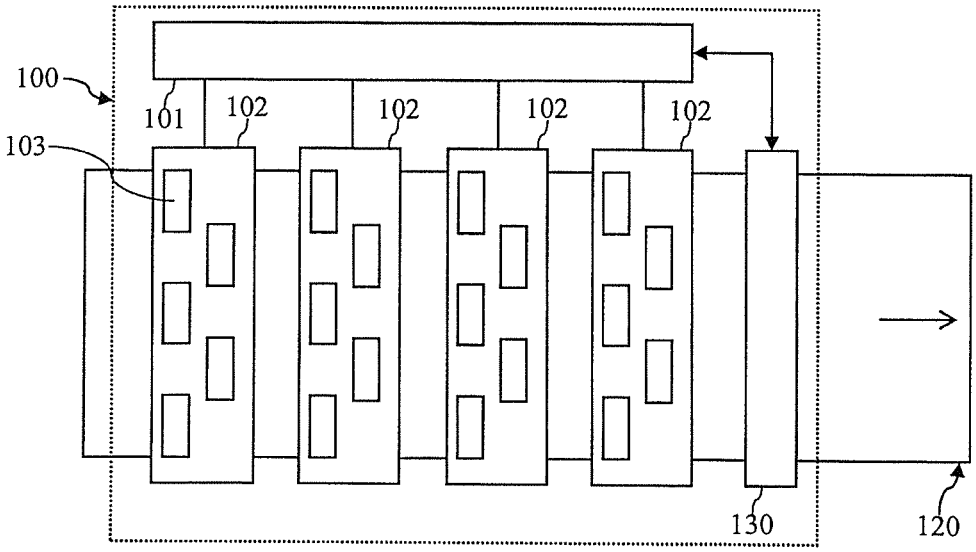
FIG. 1 is a block diagram of an example inkjet printing system.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

According to one aspect, a method is described for determining the state of a recording medium within an inkjet printing system (in particular within a dryer of the inkjet printing system). The method includes the determination of an index for the power consumption of a heating saddle past which the recording medium is directed for drying. The power consumption of the heating saddle thereby depends on a desired or nominal temperature of the heating saddle. The method furthermore comprises the determination of the state of the recording medium on the basis of an index for the power consumption.

According to a further aspect, a software (SW) program is described. The SW program may be set up in order to be executed on a processor, and thereby in order to execute the method described in this document.

According to a further aspect, a storage medium is described. The storage medium may include a SW program which is set up in order to be executed on a processor, and in order to thereby execute the method described in this document.

According to a further aspect, a controller is described for a dryer unit of an inkjet printing system, wherein the dryer comprises a heating saddle with a surface that may be heated to a desired temperature. The controller may be set up to determine an index for the power consumption of the heating saddle while a recording medium is directed past the surface of the heating saddle for drying. The power consumption of the heating saddle thereby depends on the desired temperature of the heating saddle. Furthermore, the controller may be set up in order to determine the state of the recording medium on the basis of the index for the power consumption.

According to a further aspect, an inkjet printing system with a dryer is described. The inkjet printing system comprises a controller described in this document.

As presented in the preceding, the present document deals with the efficient monitoring of a dryer of an inkjet printing system. The drying state of a recording medium dried in the dryer should thereby be determined in particular.

FIG. 1 shows a block diagram of an example inkjet printing system 100. The printing system 100 shown in FIG. 1 is designed for a continuous printing, i.e. for printing to a web-shaped recording medium 120 (also designated as "continuous feed"). The recording medium 120 is typically unrolled from a roller (the unwinder) and then supplied to the print group of the printing system 100. A print image is applied to the recording medium 120 via the print group, and after the fixing/drying of the print image the printed recording medium 120 is rolled up again on an additional roller (the take-up roller) or is cut into sheets. In FIG. 1, the movement direction of the recording medium 120 is represented by an arrow. The recording medium 120 may be produced from paper, pasteboard, cardboard, metal, plastic and/or other suitable and printable materials.

In the shown example, the print group of the printing system 100 comprises four print head systems 102 (that is also designated as a print bar). The different print head systems 102 may be used for printing with inks of different colors (for example black, cyan, magenta and/or yellow). The print group may comprise additional print head systems 102 for printing with additional colors.

A print head system 102 comprises one or more print heads 103. In the shown example, a print head system 102 respectively comprises five print heads 103. The installation bearing/orientation of a print head 103 within a print head system 102 may depend on the type of print head 103. Each print head 103 comprises one or more nozzles, wherein each nozzle is set up to fire or spray ink droplets on the recording medium 120. For example, a print head 103 may comprise 2558 effectively utilized nozzles that are arranged along one or more (for example 16) rows transverse to the travel direction of the recording medium 120. The nozzles in the individual rows may be arranged offset from one another. A respective line on the recording medium 120 may be printed transverse to the travel direction by means of the nozzle of a print head 103. An increased resolution may be provided via the use of a plurality of rows with (transversally offset) nozzles. In total, 12790 droplets may thus be sprayed onto the recording medium 120 along a transverse line by a print head system 102 shown in FIG. 1. Each print head system 102 may thus be set up to print a transverse line of a defined color on the recording medium 120 at a defined point in time.

The printing system 100 furthermore comprises a controller 101 (for example an activation hardware and/or what is known as a "bar driving board") that is set up or is suitable to activate the individual nozzles of the individual print heads 103 in order to apply a print image onto the recording medium 120 depending on print data.

The printing system 100 furthermore comprises a dryer 130 that is set up to dry the recording medium 120 after application of the ink by the one or more print head systems 102, and therefore to fix the applied print image on the recording medium 120. The dryer 130 can communicate with the controller 101 and, if applicable, be controlled by the controller 101. For example, the drying may take place depending on the quantity of ink that is applied.

Figure 2:
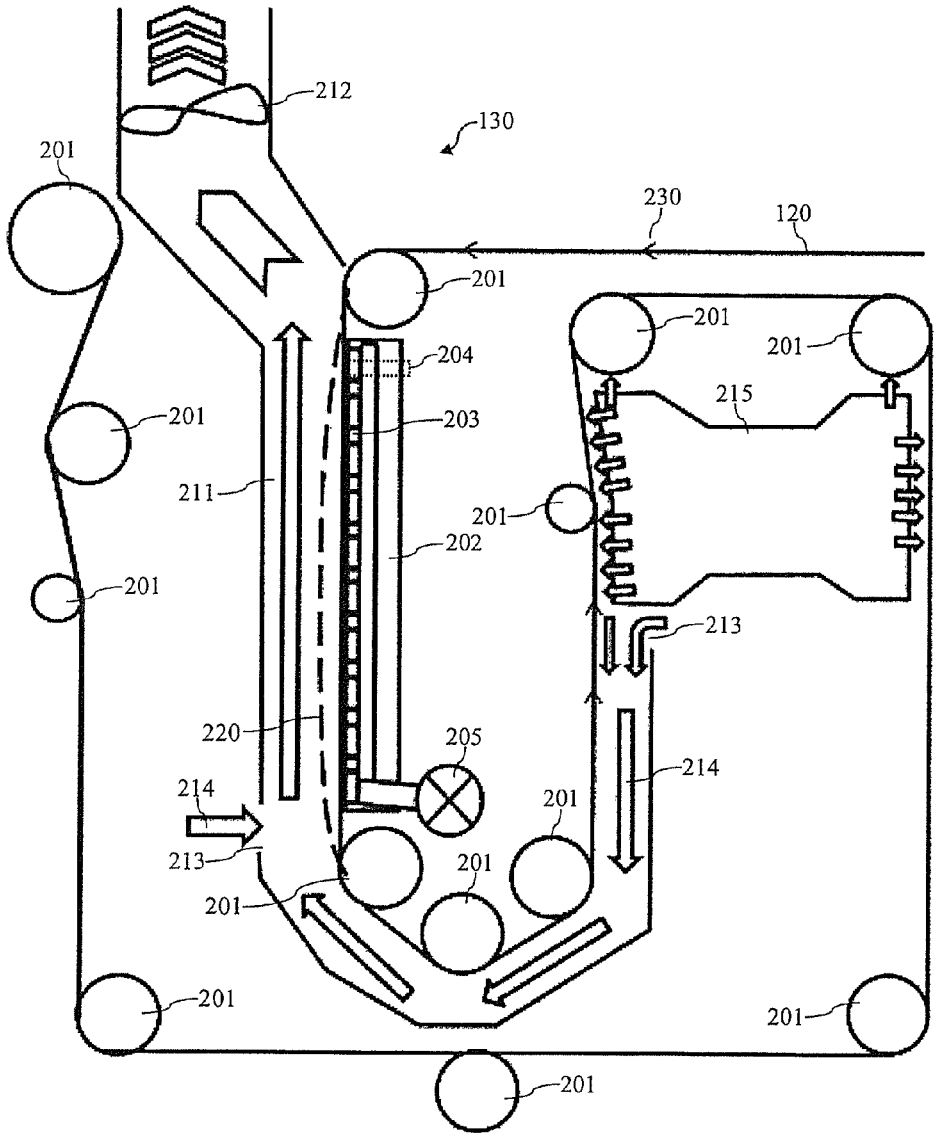
FIG. 2 shows example components of a dryer.

FIG. 2 shows example components of a dryer 130. The recording medium 120 is directed through the dryer 130 in the direction of travel 230 (by the arrows shown on the recording medium 120) by means of a plurality of guide rollers 201. In particular, the recording medium 120 is directed past a heating saddle 202 that is set up to heat the recording medium 120. The moisture that is thereby evaporated is transported away from the recording medium 120 by an air current 214 (represented by arrow bars) via an exhaust air duct 212. Via the exhaust air duct 212, air is directed through an airway 211 past the heating saddle 202. The airway 211 has one or more openings 213 in order to be able to draw fresh air from the environment of the dryer 130 into the airway 211.

The heated recording medium 120 may furthermore be directed past a cooler 215 that is set up to cool the recording medium 120 again, for example to ambient temperature. It may thus be ensured that the recording medium 120 has a defined state for the following processing steps (for example for a following print group to print to the back side of the recording medium 120).

The heating saddle 202 may have a flat surface. In this case, channels 203 which are supplied with negative pressure via through-holes from the back side of the saddle are typically located on the surface of the heating saddle. The contact between the recording medium 120 and the heating saddle 202 is ensured via the applied negative pressure, wherein the recording medium 120 is drawn more or less strongly onto the heating saddle 202 depending on the negative pressure. Without negative pressure, the paper may lift away from the heating saddle due to the relatively high exhaust flow 214 between the recording medium 120 and the air channel 211. FIG. 2 shows an example curve of a recording medium 220 that has lifted away (dashed line).

A lifting away of the recording medium 120 may be used to interrupt a drying of the recording medium 120. For example, given a downtime or given a reduced travel velocity of the recording medium 120, an overdrying of the recording medium 120 may thus be prevented. For this purpose, the negative pressure present at the heating saddle 202 may be interrupted as needed in order to separate the recording medium 120 from the flat surface of the heating saddle 202. The possibility of lifting away the recording medium 120 is typically not present given a heating saddle 202 with a curved (convex) surface, since in this case the recording medium 120 is already held on the surface of the heating saddle 202 by the tension of the recording medium 120 in the direction of travel 230, and by the arc of wrap due to the curved shape.

While the intentional lifting of the recording medium 120 is advantageous with regard to the avoidance of overdrying, an unintentional lifting may be disadvantageous with regard to a desired drying of the recording medium 120. An undried or insufficiently dried recording medium 120 may lead to a contamination of the printing system 100 and/or to a negative effect on the print image.

For example, an unintentional lifting of the recording medium 120 may be caused by an unnoticed reduction of the negative pressure at the surface (in particular in the channels 203) of the heating saddle 202. Depending on the type and/or quality of the recording medium 120 (paper, for example) that is used, the negative pressure channels 203 may be contaminated with paper dust and/or with abraded ink particles. If the channels 203 are very contaminated, negative pressure may no longer be built up between the recording medium 120 and the surface of the heating saddle 202. In this case, the paper lifts away from the surface of the heating saddle 202 due to the present air flow 214. This is therefore in particular the case that a negative pressure that counteracts the negative pressure at the surface of the heating saddle 202 is generated by the present air flow 214 (typically with a relatively high volume) in the air channel 211. Due to an unnoticed reduction of the negative pressure at the surface of the heating saddle 202, the negative pressure caused by the air flow 213 may exceed the reduced negative pressure at the surface of the heating saddle 202, and the recording medium 120 may thereby lift the recording medium 120 away from the surface of the heating saddle 202.

The lifting of the recording medium 120 could be detected by a dedicated contact monitoring (for example via a video monitoring). However, such a dedicated contact monitoring is connected with additional costs. Alternatively or additionally, the function of the drying of the dryer 130 could take place via a no-contact web temperature sensor at the outlet/exit of the dryer 130. However, this is also connected with additional costs and maintenance efforts for the cleaning of the sensor optics.

A cost-effective method to determine the lifting state of the recording medium 120 is described in this document. No additional hardware components that would lead to additional costs and maintenance efforts are required for the described method.

In order to achieve the desired drying of the recording medium 120, the temperature of the one or more heating saddles 202 of the dryer 130 is typically regulated. For this, the temperature in the one or more heating saddles 204 (also designated as thermo-elements) is measured with the aid of one or more temperature sensors 204, and the power output to the one or more heating saddles 202 is adapted by a power supply module 205 in order to regulate the temperature in the one or more heating saddles 202 to a predefined desired temperature. The electrical power consumed by the one or more heating saddles 202 in a time interval thereby coincides with the thermal power emitted to the recording medium 120.

The power supply to the one or more heating saddles 202 thereby typically occurs via heating cartridges which are arranged in the one or more heating saddles 202. For example, the regulation of the temperature can take place such that the heating cartridges are turned on or activated at regular intervals—depending on the travel velocity of the recording medium 120, on the recording medium 120 used and/or on the applied ink quantity—in order to compensate for the heat losses of the one or more heating saddles 202.

Figure 3A:
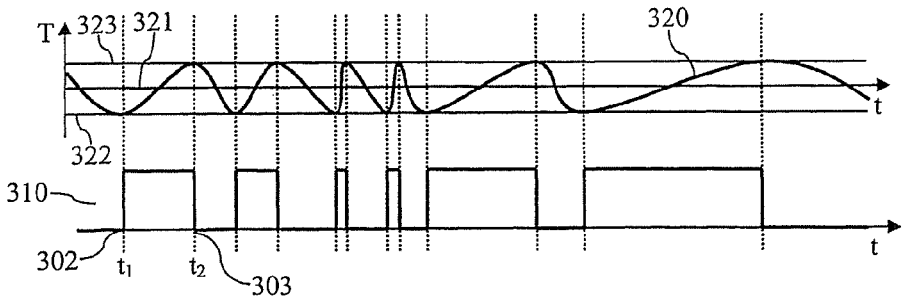
FIG. 3*a* and FIG. 3*b* show example time curves of the power consumption of the dryer.

Such a regulation is shown as an example in FIG. 3*a*. FIG. 3*a* shows the temperature curve 320 over time t, measured at a temperature sensor 204. FIG. 3*a* additionally shows the desired temperature 321 as well as an upper temperature threshold 323 and a lower temperature threshold 322. Furthermore, FIG. 3*a* shows a corresponding power curve 310 over time t. The power curve 310 fluctuates between the level "no power consumption" or "off" and the level "full power consumption" or "on". Given a rising edge at point in time $t_1$ 302, a heating cartridge is switched on or activated in order to heat a heating saddle 202. This occurs if the measured temperature reaches or falls below the lower temperature threshold 322. At the point in time $t_2$ 303 (given a falling edge of the power curve 310), the heating cartridge is switched off or deactivated and the power consumption is interrupted. This occurs if the measured temperature reaches or exceeds the upper temperature threshold 323.

The power curve 310 reflects the time curve of the electrical power emitted to the one or more heating saddles 202. The electrical power that is received by the one or more heating saddles 202 corresponds to the thermal power that is emitted by the one or more heating saddles 202 (in particular to the recording medium 120). In other words, the electrical power received by the one or more heating saddles 202 at a predefined time interval corresponds (possibly with a time offset) to the thermal power emitted at the predefined time interval by the one or more heating saddles 202.

Figure 3B:
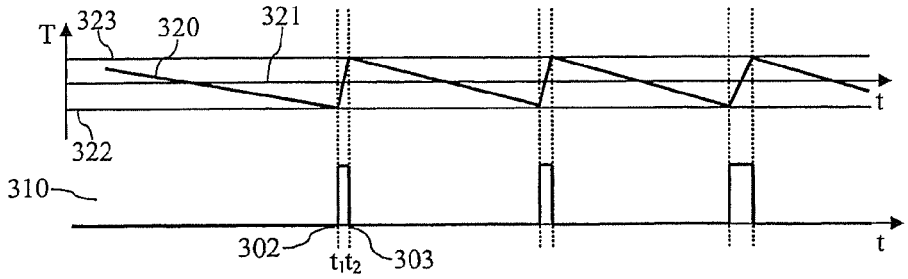

If the recording medium 120 lifts away from the surface of the one or more heating saddles 202, the thermal power that is drawn from the one or more saddles 202 typically decreases. The electrical power that must be supplied to the heating cartridges of the heating saddles 202 decreases accordingly in order to keep the heating saddles 202 at the desired temperature 321. This is shown as an example in FIG. 3*b*. It is clear that the power curve 310 clearly more rarely/briefly assumes the level of "on" given a lifted recording medium 120 than given a recording medium 120 that is in contact with the surface of the one or more heating saddles 202.

The reduced and/or absent power consumption of the one or more heating saddles 202 or a modified count of switching cycles or on/off cycles of the power curve 310 may be evaluated as an indication that the recording medium 120 has lifted away from the surface of the one or more heating saddles. For example, if a heating saddle 202 does not switch on in order to heat the surface of the heating saddle 202 for a defined period of time (for example for multiple seconds) in a printing operation, this is a reliable sign that the recording medium 120 no longer rests on the heating saddle 202.

Figure 4:
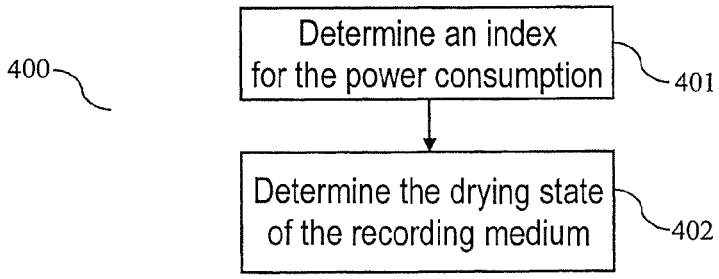
FIG. 4 is a workflow diagram of an example method to determine the state of a recording medium.

FIG. 4 shows a workflow diagram of an example method 400 to determine the state of a recording medium 120 within an inkjet printing system 100, in particular within the dryer 130 of an inkjet printing system 100. The method 400 includes the determination 401 of an index for the (electrical) power consumption of a heating saddle 202 past which the recording medium 120 is directed for drying. The index for the power consumption may in particular include an index for the electrical power consumed by the heating saddle 202 in a predefined time period. In other words, the index for the power consumption may depend on the amount of electrical power consumed by the heating saddle 202. In particular, the index may depend on a time curve 310 of the power consumed by the heating saddle 202.

The power consumption of the heating saddle 202 thereby depends on a desired temperature 321 of the heating saddle 202. In particular, the temperature T of the heating saddle 202 may be regulated to the desired temperature 321. Electrical power or electrical energy is thereby typically supplied to the heating saddle 202 (in particular a heating cartridge in the heating saddle 202) such that the temperature of the heating saddle 202 lies approximately at the desired temperature 321 over time t.

The index for the power consumption thus typically depends on the desired temperature. In particular, the index for the power consumption may increase if the desired temperature increases. On the other hand, the index for the power consumption may decrease if the desired temperature decreases.

An example regulation of the desired temperature 321 may take place such that an electrical heating of the heating saddle 202 is activated if the temperature of the heating saddle 202 reaches or falls below a lower temperature threshold 322, wherein the lower temperature threshold 322 is less than the desired temperature 321. Furthermore, the electrical heating of the heating saddle 202 may be deactivated if the temperature of the heating saddle 202 reaches or exceeds an upper temperature threshold 323, wherein the upper temperature threshold 323 is greater than the desired temperature 321. The consumption of electrical energy or electrical power by the heating saddle 202 may thus take place in pulses in which the heating of the heating saddle 202 is activated and deactivated again.

For example, the index for the power consumption may then include the incidence/frequency of the activation pulses. Alternatively or additionally, the index for the power consumption may include the number of activations/pulses in a predefined time interval. Alternatively or additionally, the index for the power consumption may include a duration of the electrical heating of the heating saddle 202, i.e. a duration of the pulses. Alternatively or additionally, the index for the power consumption may include or take into account an amount of electrical power consumed by the heating saddle 202 per time unit upon heating.

The method 400 additionally includes the determination 402 of the state of the recording medium 120 on the basis of the index for the power consumption. An example state is that the recording medium 120 rests on a surface of the heating saddle 202, which typically leads to a substantial transfer of thermal energy from the heating saddle 202 to the recording medium 120. An additional example state is that the recording medium 120 is not in direct contact with the surface of the heating saddle 202. A lack of contact typically leads to a substantially reduced transfer of thermal energy from the heating saddle 202 to the recording medium 120. An additional example state is that, after being directed past the heating saddle 202, the recording medium 120 has a degree of moisture that is greater than or equal to a predefined moisture threshold. The predefined moisture threshold may thereby be chosen such that a sufficient drying/fixing of the print image has occurred given a degree of moisture below the moisture threshold, and/or that a sufficient drying/fixing of the print image has not occurred given a degree of moisture above the moisture threshold.

The recording medium 120 is typically in direct contact with the heating saddle 202 in order to ensure a reliable heating and drying of the recording medium 120. However, due to a malfunction of the heating saddle 202 (for example due to a blockage of the negative pressure channels 203) it may occur that there is no direct contact between the surface of the heating saddle 202 and the recording medium 120. In such a case, a reliable drying of the recording medium 120 typically does not occur. As was already presented above, the consumption of electrical power by the heating saddle 202 is a reliable index for the amount of thermal energy that is emitted by the heating saddle 202. A reduced consumption of electrical power thus indicates that no contact exists between recording medium 120 and heating saddle 202, and thus that the recording medium 120 has too high a degree of moisture after being directed past the heating saddle 202. Using the curve 310 of the electrical power consumption of the heating saddle 202 of the dryer 130 of the printing system 100, it may thus be detected whether the recording medium 120 rests on the surface of the heating saddle 202 or not.

Via the method 400 described in this document, the state of the recording medium 120 (and in particular a lifting of the recording medium 120) may be determined in a reliable and cost-effective manner upon exiting the drying, without the use of dedicated temperature sensors.

The method 400 may additionally include the comparison of the index for the power consumption with a predefined power threshold. For example, the frequency of the activation pulses may be compared with a frequency threshold. The state of the recording medium 120 may then be determined depending on whether the index for the power consumption is greater than or less than the predefined power threshold. For example, a lifting of the recording medium 120 may be concluded if the current frequency of the activation pulses is less than the predefined frequency threshold. The state of the recording medium 120 may thus be efficiently determined via a comparison.

The method may additionally include the determination that a negative pressure is applied to the heating saddle 202 in order to draw the recording medium 120 onto a surface of the heating saddle 202. Furthermore, on the basis of the index for the power consumption it may be determined that the recording medium 120 is not in direct contact with the surface of the heating saddle 202. An unintentional lifting of the recording medium 120 may thus be determined.

If it is determined that the recording medium 120 is not in direct contact with the surface of the heating saddle 202, it may be induced that a printing process of the inkjet printing system 100 is interrupted. It may thus be ensured that a quantity of spoilage that is caused by incorrect drying is limited and/or that a contamination of components of the inkjet printing system 100 due to insufficiently dried ink is avoided.

As was presented above, a noteworthy heat transfer typically no longer occurs if the recording medium 120 is lifted. That means that the printing system 100 in practice runs without drying. However, the drying of the printed, damp recording medium 120 is required since the printed recording medium 120 in the undried state has no or only a slight wear resistance and smears upon contact with rollers or web-guiding elements in both the printing system 100 and in post-processing. Moreover, rollers and web-guiding elements are contaminated by the undried print image. Contaminated rollers lead to a re-transfer of ink to the following sections of the recording medium 102, which in turn produces spoilage. Without a corresponding function monitoring of the drying, it may thus occur that a great deal of spoilage (faults) is produced due to insufficient drying, which spoilage is not usable due to damage to the print image. The damage is thereby typically registered only in the post-processing. Both spoilage and the contamination of the printing system 100 by ink may be prevented via the monitoring of the power consumption as described in this document.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A method to determine a lift state of a recording medium from a surface of a heating saddle of an inkjet printing system, the recording medium being directed past the surface of the heating saddle for drying, comprising the steps of:

determining an index for power consumption of the heating saddle, the determining of the index for the power consumption including a determination of a time curve of the electrical power consumed by the heating saddle, the power consumption of the heating saddle depending on a desired temperature of the heating saddle; and determining a lift state of the recording medium based on the index for the power consumption without using a sensor to measure a temperature of the recording medium.

2. The method according to claim 1 wherein the lift state includes at least one of the following states:

the recording medium rests on a surface of the heating saddle;

the recording medium is not in direct contact with the surface of the heating saddle; and after being directed past the heating saddle, the recording medium has a degree of moisture that is greater than or equal to a predefined moisture threshold.

3. The method according to claim 1 wherein the index for the power consumption includes an index for electrical power consumed by the heating saddle in a predefined time period.

4. The method according to claim 1 wherein the index for the power consumption:

depends on the desired temperature;

increases if the desired temperature increases; and decreases if the desired temperature decreases.

5. The method according to claim 1 wherein a temperature of the heating saddle is regulated relative to the desired temperature.

6. The method according to claim 1 wherein:

an electrical heating of the heating saddle is activated if a temperature of the heating saddle reaches or falls below a lower temperature threshold;

the lower temperature threshold is less than the desired temperature;

the electrical heating of the heating saddle is deactivated if the temperature of the heating saddle reaches or exceeds an upper temperature threshold; and the upper temperature threshold is greater than the desired temperature.

7. The method according to claim 6 wherein the index for the power consumption includes at least one of:

a frequency of the activation of the electrical heating of the heating saddle;

a time interval between two successive activations of the electrical heating of the heating saddle;

a duration of the electrical heating of the heating saddle; and an electrical energy consumed by the heating saddle per time unit upon heating.

8. The method according to claim 1 additionally including comparing the index for the power consumption with a predefined power threshold; and determining the lift state of the recording medium depending on whether the index for the power consumption is greater than or less than the predefined power threshold.

9. A method to determine a lift state of a recording medium from a surface of a heating saddle of an inkjet printing system, the recording medium being directed past the surface of the heating saddle for drying, comprising the steps of:

determining an index for power consumption of the heating saddle, the determining of the index for the power consumption including a determination of a time curve of the electrical power consumed by the heating saddle, the power consumption of the heating saddle depending on a desired temperature of the heating saddle;

determining a lift state of the recording medium based on the index for the power consumption including determining that a negative pressure is applied to the heating saddle in order to draw the recording medium onto a surface of the heating saddle, and on the basis of the index for the power consumption, determining that the recording medium is not in direct contact with the surface of the heating saddle; and thereupon inducing a printing process of the inkjet printing system to be interrupted.

10. A controller for a dryer of an inkjet printing system, the dryer including a heating saddle with a surface heated to a desired temperature, the controller performing the steps of:

determining an index for power consumption of the heating saddle while a recording medium is directed past the surface of the heating saddle for drying, the determining of the index for the power consumption including a determination of a time curve of electrical power consumed by the heating saddle, the power consumption of the heating saddle depending on the desired temperature of the heating saddle; and determining a lift state of the recording medium from a surface of the heating saddle based on the index for the power consumption without using a sensor to measure a temperature of the recording medium.

11. An inkjet printing system, comprising:

a plurality of inkjet print heads followed by a dryer comprising a heating saddle with a surface heated to a desired temperature; and a controller for the dryer which determines an index for power consumption of the heating saddle while a recording medium is directed past the surface of the heating saddle for drying, the index for the power consumption including a determination of a time curve of electrical power consumed by the heating saddle, the power consumption of the heating saddle depending on the desired temperature of the saddle, and the controller determining a lift state of the recording medium from a surface of the heating saddle based on the index for the power consumption without using a sensor to measure a temperature of the recording medium.

* * * * *